US007306440B2

(12) United States Patent
Amano

(10) Patent No.: US 7,306,440 B2
(45) Date of Patent: Dec. 11, 2007

(54) VANE PUMP INCLUDING ROTOR HAVING ECCENTRIC GRAVITY CENTER

(75) Inventor: Hitoshi Amano, Okazaki (JP)

(73) Assignee: Denso Corporation (JP)

( * ) Notice: Subject to any disclaimer, the term of this patent is extended or adjusted under 35 U.S.C. 154(b) by 2 days.

(21) Appl. No.: 11/267,302

(22) Filed: Nov. 7, 2005

(65) Prior Publication Data

US 2006/0099099 A1 May 11, 2006

(30) Foreign Application Priority Data

Nov. 5, 2004 (JP) ..... 2004-321909

(51) Int. Cl.
*F01C 21/00* (2006.01)
*F03C 2/00* (2006.01)

(52) U.S. Cl. ..... 418/151; 418/39; 418/259

(58) Field of Classification Search ..... 418/151, 418/259, 266–268, 270, 39
See application file for complete search history.

(56) References Cited

U.S. PATENT DOCUMENTS 4,925,378 A * 5/1990 Ushiku et al. ..... 418/255
2006/0099102 A1* 5/2006 Kato et al. ..... 418/259

FOREIGN PATENT DOCUMENTS

EP 1239115 A2 * 9/2002
JP 5-58888 8/1993
JP 2003-222089 8/2003

* cited by examiner

*Primary Examiner*—Theresa Trieu
(74) *Attorney, Agent, or Firm*—Nixon & Vanderhye PC

(57) ABSTRACT

A vane pump includes a casing having a cylindrical inner bore and a rotor disposed in the inner bore with an eccentric relation thereto, forming a circular pump chamber between the rotor and the inner bore. The circular pump chamber is divided by vanes held in the rotor into pump chambers changing their capacities according to rotation of the rotor. A gravity center of the rotor is shifted from the rotational center of the rotor by removing or adding some weight, so that an imbalanced centrifugal force is applied to the rotor. The driving shaft and the rotor are tightly coupled to each other by the imbalanced centrifugal force even if there is a small gap or dimensional errors therebetween.

7 Claims, 3 Drawing Sheets

VANE PUMP INCLUDING ROTOR HAVING ECCENTRIC GRAVITY CENTER

CROSS-REFERENCE TO RELATED APPLICATION

This application is based upon and claims benefit of priority of Japanese Patent Application No. 2004-321909 filed on Nov. 5, 2004, the content of which is incorporated herein by reference.

BACKGROUND OF THE INVENTION

1. Field of the Invention

The present invention relates to a vane pump for compressing fluid.

2. Description of Related Art

An example of a vane pump having a rotor rotating in an eccentric relation with respect to an inner bore of a casing is disclosed in JP-A-2003-222089. The rotor rotates in the inner bore of the casing at a high speed. If there is dimensional errors in the housing and the rotor, or there is an inclination in coupling the rotor with a driving shaft, it is possible that the rotor contacts the inner bore of the casing. If this happens, noises will be generated, and the rotor and the casing will be damaged by abrasion. In the worst case, the rotor will be locked. Further, the rotor may be deformed in a process of press-fitting the driving shaft into the rotor.

In order to avoid these troubles, all the components of the vane pump, i.e., the driving shaft, the rotor and the casing have to be machined with a high precision. Alternatively, it would be preferable to loosely couple the driving shaft to the rotor with a certain gap therebetween to absorb dimensional errors. However, if there is a gap between the driving shaft and the rotor, the rotor vibrates relative to the driving shaft when it is rotated, generating noises and making compression pressure unstable.

SUMMARY OF THE INVENTION

The present invention has been made in view of the above-mentioned problems, and an object of the present invention is to provide an improved vane pump which is easily manufactured and stably operates with low noises.

The vane pump is composed of a casing having a cylindrical inner bore, a rotor disposed in the inner bore to form a circular pump chamber between the inner bore and rotor, and a driving shaft for rotating the rotor. The rotor is disposed in the inner bore of the casing so that a rotational center of the rotor is positioned eccentric with respect to the center of the inner bore. Vanes are slidably held in grooves formed in the rotor, and radial ends of the vanes contact the inner bore by a centrifugal force generated according to rotation of the rotor. The circular pump chamber is divided by the vanes into a few pump chambers changing their capacities according to rotation of the rotor. Fluid is introduced into the pump chamber and compressed therein, and the compressed fluid is pumped out of the vane pump.

The driving shaft is coupled to the rotor with a small gap therebetween. A gravity center of the rotor is positioned to be eccentric with respect to the rotational center of rotor, so that an imbalanced centrifugal force is applied to the rotor when the rotor is rotated. The driving shaft and the rotor are closely coupled to each other by the imbalanced centrifugal force notwithstanding the small gap therebetween.

The gravity center of the rotor maybe shifted by removing some weight from the rotor. A depression or depressions may be formed in the rotor to remove some weight. A cutout groove or grooves may be made on the circumferential surface of the rotor. Alternatively, some weight may be added to the rotor to place the gravity center eccentrically with the rotational center. In this case, a material heavier than the rotor material may be disposed in holes formed on the rotor.

According to the present invention, it is not required to machine the driving shaft and the rotor with a high precision or to press-fit the driving shaft into the rotor. A small gap between the driving shaft and the rotor or some dimensional errors are overcome by the imbalanced centrifugal force, and the driving shaft is tightly coupled to the rotor. The vane pump can be operated under a stable pressure with low noise.

Other objects and features of the present invention will become more readily apparent from a better understanding of the preferred embodiments described below with reference to the following drawings.

DETAILED DESCRIPTION OF THE PREFERRED EMBODIMENTS

Figure 1:
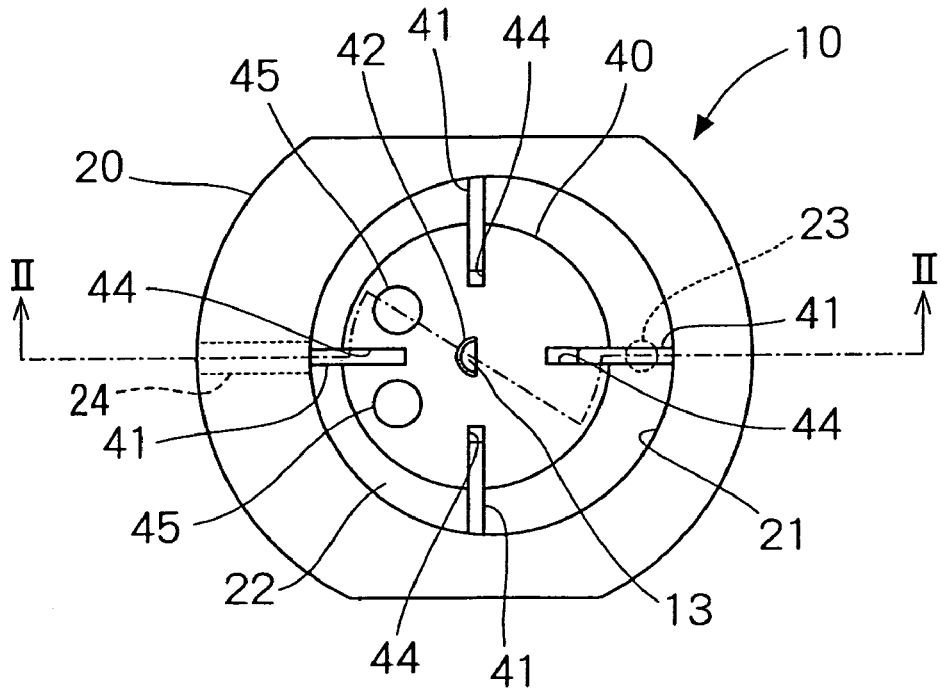
FIG. 1 is a plan view showing a vane pump as a first embodiment of the present invention, viewed from direction I shown in FIG. 2, removing an upper plate.

A first embodiment of the present invention will be described with reference to FIGS. 1-3. A vane pump pressurizes fluid such as liquid or gas sucked thereinto. In this particular embodiment shown in FIG. 1, fluid is pressurized therein. A vane pump 10 includes: a casing composed of a ring 20 and a pair of plates 31, 32; a rotor 40; vanes 41; and a driving shaft 13. The rotor 40 disposed in an inner bore 21 of the ring 20 is coupled to the driving shaft 13 and rotated by a motor 11. The motor 11 may be an electric motor such as a direct current motor or an alternating current motor. The motor 11 is contained in a cover 12.

The ring 20 is cylinder-shaped and has a cylindrical inner bore 21. The inner bore 21 may be formed in an oval form. Both axial ends of the ring 20 are closed with a pair of plates 31 and 32. The plate 31 is a lower plate positioned at the motor side and the plate 32 is an upper plate, as shown in FIG. 2. The rotor 40 is disposed in the inner bore 21 of the ring 20. A rotational center of the rotor 40, where a center hole 42 coupled to the driving shaft 13 is formed, is positioned in an eccentric relation with respect to a center of the inner bore 21. A space between the rotor 40 and the inner bore 21 of the ring 20 closed with the plates 31, 32 constitutes a circular pump chamber 22. A capacity of the pump chamber 22 is not uniform in its circular direction, but continuously changes as shown in FIG. 1 because of the eccentric positioning of the rotor 40 relative to the inner bore 21.

Figure 2:
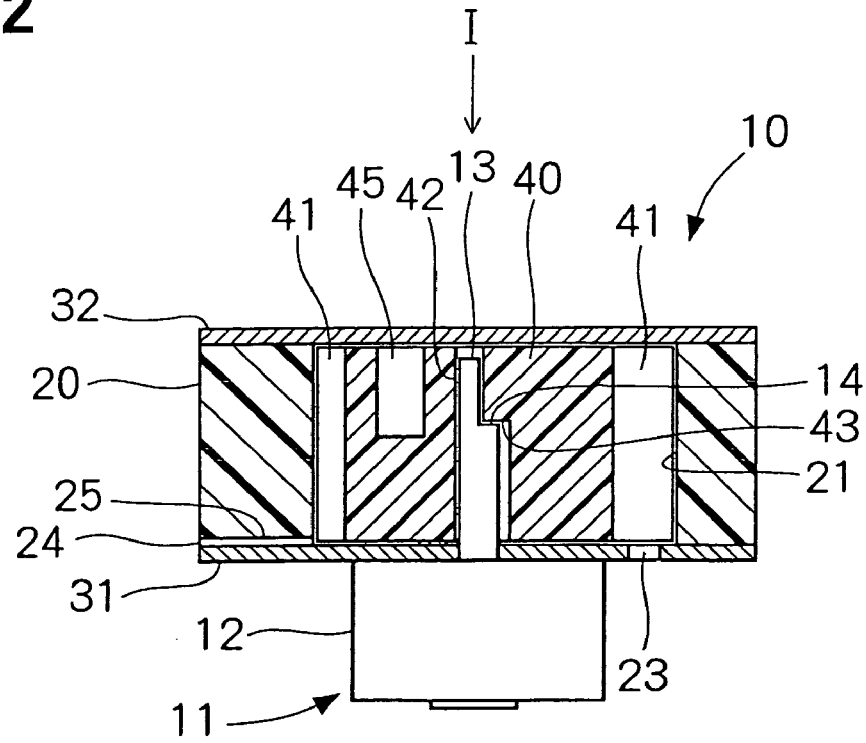
FIG. 2 is a cross-sectional view showing the vane pump, along line II-II shown in FIG. 1.
Figure 3:
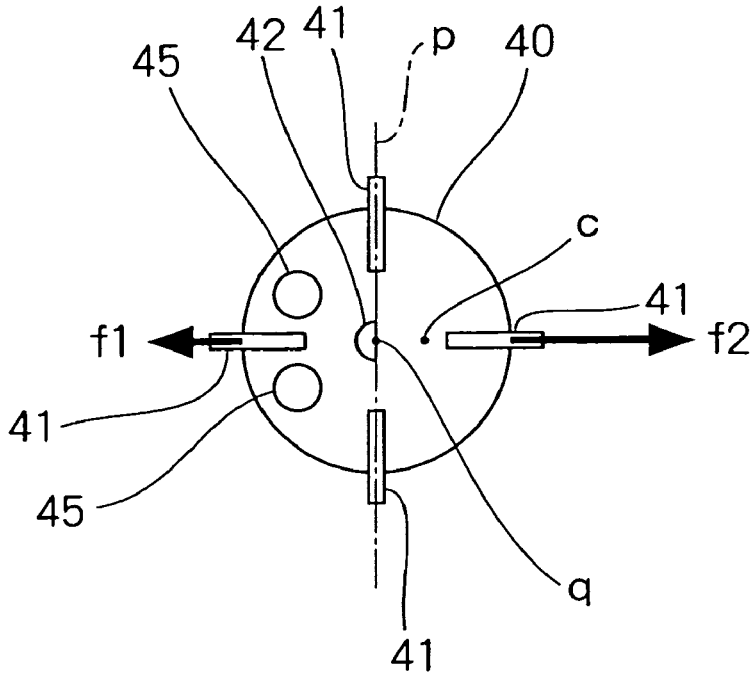
FIG. 3 is a schematic view showing a rotor of the vane pump.

As shown in FIG. 2, an inlet port 23 communicating with the pump chamber 22 is formed in the lower plate 31, and an outlet passage 24 communicating with the pump chamber 22 is formed between a groove 25 of the lower plate 31 and the ring 20. According to rotation of the rotor 40, fluid is sucked into the pump chamber 22 from the inlet port 23, pressurized in the pump chamber 22 and pumped out through the outlet passage 24.

The rotor 40 has a center hole 42 formed in the rotational center of the rotor 40. The driving shaft 13 is inserted into the center hole 42. As shown in FIG. 2, the center hole 42 has a circular cross-section from the lower end up to its middle portion and has a half circular cross-section from the middle portion to the upper end, thereby forming a step 43 at the middle portion. The driving shaft 13 has a cross-section corresponding to the cross-section of the center hole 42. That is, a lower portion of the driving shaft 13 has a circular cross-section and its upper portion has a half circular cross-section, forming a step 14 at its middle portion.

The half circular cross-section of the driving shaft 13 is composed of an arc portion and a chord portion that are coupled to those of the half circular cross-section of the center hole 42. When the driving shaft 13 is coupled to the rotor 40, the step 14 of the driving shaft 13 abuts the step 43 of the center hole 42. The outer diameter of the driving shaft 13 is made a little smaller than that of the center hole 42, so that a small gap exists between the driving shaft 13 and the center hole 42.

The rotor 40 has grooves 44, formed in its outer periphery, extending in the axial direction. In this particular embodiment, four grooves 44 are formed at an equal interval. The number of the vanes 41 is not limited to four but it may be variously selected. A vane 41 is disposed in each groove 44 so that the vane 41 is able to reciprocally move in the groove 44 in the radial direction. A distance between the outer periphery of the rotor 40 and the inner bore of the ring 20 changes according to rotation of the rotor 40 because the rotor 40 is eccentric with respect to the inner bore 21. An outer end of each vane 41 contacts the inner bore 21 by a centrifugal force generated according to rotation of the rotor 40. As the distance between the outer periphery of the rotor 40 and the inner bore 21 changes according to rotation of the rotor 40, the vane 41 slidably moves in the groove 44 in the radial direction.

The rotor 40 has depressions 45 extending in its axial direction up to a middle portion of the rotor 40. In this particular embodiment, two depressions 45 are formed. By making the depressions 45, some of the rotor mass is removed. As shown in FIG. 3, the rotor weight of the left half with respect a symmetric line "p" in FIG. 3 becomes lighter than that of the right half. In other words, a gravity center of the rotor 40 moves from a rotational center "q" to a point "c" (a new gravity center).

When the rotor 40 rotates around the rotational center q, a centrifugal force is applied to the rotor. Since the gravity center c is positioned at the right side of the rotational center q, a centrifugal force f2 toward the right side is larger than a centrifugal force f1 toward the left side. Therefore, the rotor 40 is pushed against the driving shaft 13 in the rightward direction (in FIG. 3). This means that the rotor 40 is pushed against the arc portion of the half circular cross section of the driving shaft 13. In this manner, the rotor 40 is tightly coupled to the driving shaft 13 although the small gap is provided between the driving shaft 13 and the center hole 42 of the rotor 40.

In this particular embodiment, the depressions 45 are formed at the arc portion side of the half circular cross-section. Therefore, the arc portion of the center hole 42 closely contacts the arc portion of the driving shaft 13. The rotor 40 and the driving shaft 13 are more closely coupled to each other than they are coupled by making a contact between the chord portions. It is not required to machine the center hole 42 and the driving shaft 13 with a high precision because the rotor 40 and the driving shaft 13 are tightly coupled to each other with a help of the imbalance of the centrifugal force.

Operation of the vane pump 10 will be briefly described. Fluid is sucked into the pump chamber 22 through the inlet port 23 and compressed in the pump chamber 22, and then the compressed fluid is pushed out through the outlet passage 24. The pump chamber between a pair of the neighboring vanes is the largest at the position of the inlet port 23. The pump chamber 22 becomes gradually smaller according to rotation of the rotor 40 and becomes the smallest at the outlet passage 24. The radial outer ends of the vanes 41 always contact the inner bore 21 of the ring 20 because of the centrifugal force applied to the vanes 41. Accordingly, the fluid is continuously compressed in the pump chamber 22 and delivered out through the outlet passage 24.

Advantages of the present invention will be summarized below. The gravity center c is shifted from the rotational center q by removing some of the rotor mass. When the rotor 40 is rotated, the rotor 40 is pushed toward the driving shaft 13 by the imbalance of the centrifugal force imposed on the rotor 40. The rotor 40 is tightly coupled to the shaft 13 even if there is a small gap between the center hole 42 of the rotor 40 and the driving shaft 13. Therefore, it is not required to machine the driving shaft 13 and the center hole 42 with a high precision. It is not necessary to press-fit the driving shaft 13 into the center hole 42 of the rotor 40. Since the rotor 40 is tightly coupled to the driving shaft 13, a stable pumping pressure is obtained while suppressing noises in operation. The gravity center c can be arbitrarily positioned by selecting the depth, the number and the position of the depressions 45.

Figure 4:
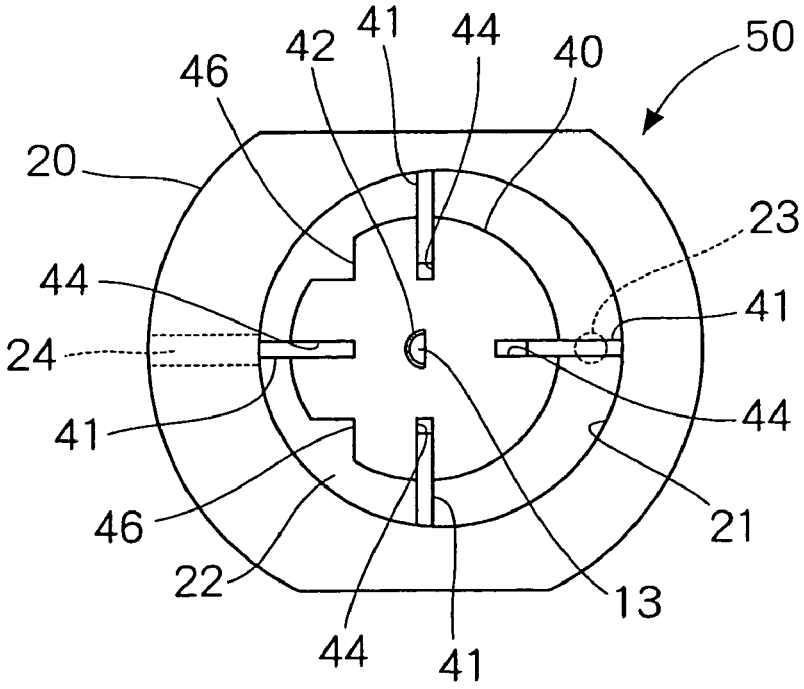
FIG. 4 is a plan view showing a vane pump as a second embodiment of the present invention.

A second embodiment of the present invention is shown in FIG. 4. In this embodiment (a vane pump 50), cutout grooves 46 are formed on the outer periphery of the rotor 40 in place of the depressions 45 in the first embodiment. Other structures are the same as those of the first embodiment. A certain mass of the rotor 40 are removed by making the cutout grooves 46. The gravity center of the rotor 40 is shifted from the rotational center. The rotor 40 is tightly coupled to the driving shaft 13 by the imbalance of the centrifugal force in the same manner as in the first embodiment.

Figure 5:
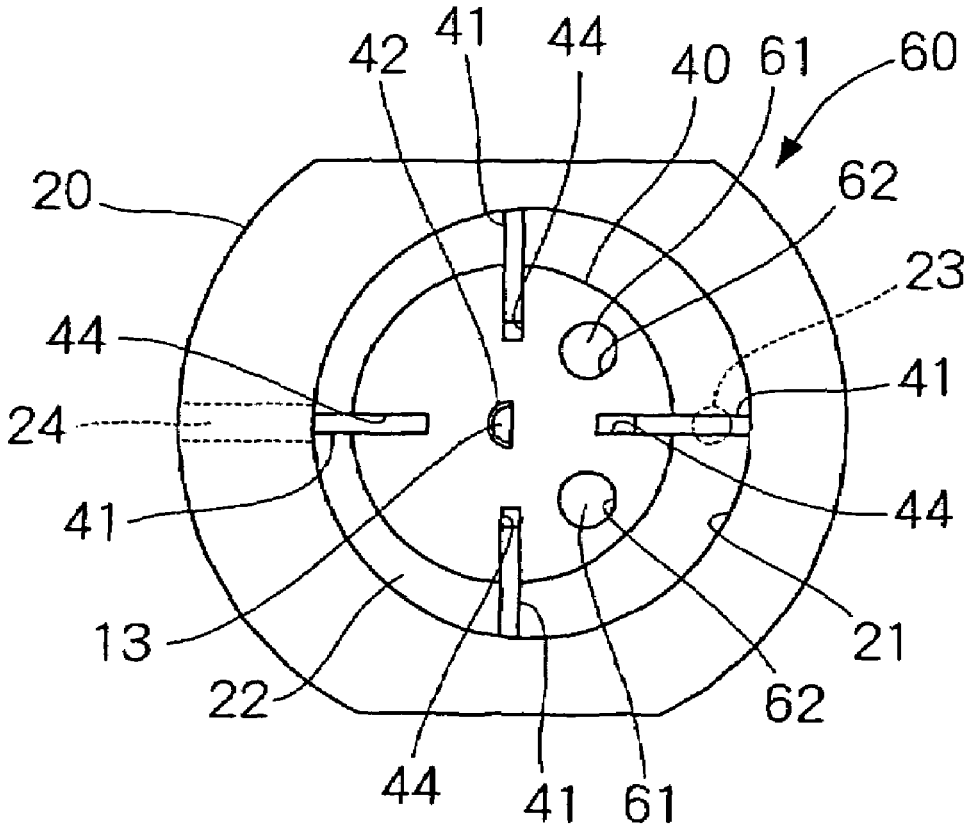
FIG. 5 is a plan view showing a vane pump as a third embodiment of the present invention.

A third embodiment of the present invention is shown in FIG. 5. In this embodiment (a vane pump 60), some weight is added to the rotor 40 instead of removing some weight. Other structure is the same as those of the first embodiment. As shown in FIG. 5, depressions 62 are formed in the axial direction, and the depressions 62 are filled with weights 61 that are heavier than the rotor material. In this manner, the gravity center of the rotor 40 is shifted from its rotational center. In this particular embodiment shown in FIG. 5, the gravity center is positioned at the right side of the rotational center. The rotor 40 can be tightly coupled to the driving shaft 13 in the same manner as in the first embodiment. The weight 61 is tightly kept in the depression 62 not to contact the upper plate 32.

The present invention is not limited to the embodiments described above, but it may be variously modified. For example, though the depressions 45 are formed at the side of the upper plate 32 in the first embodiment, they may be formed at the side of the lower plate 31. Similarly, the weights 61 in the third embodiment may be positioned at the side of the lower plate 31. The rotor 40 may be made of a resin mold. In this case, the weights 61 in the third embodiment may be made of a heavy metallic material and embedded in the molded resin.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A vane pump for compressing fluid, comprising:

a casing having a cylindrical inner bore;

a rotor disposed in the inner bore with an eccentric relation thereto, forming a circular pump chamber between the inner bore and the rotor;

vanes slidably held in the rotor so that one end of each vane slidably contacts the inner bore by a centrifugal force generated by rotation of the rotor, the circular pump chamber being divided by the vanes to thereby form pump chambers each having a capacity changing according to rotation of the rotor; and a driving shaft for rotating the rotor, wherein:

the driving shaft is coupled to a rotational center of the rotor with a small gag therebetween; and a gravity center of the rotor is positioned eccentrically with respect to its rotational center by one of shaping and forming said rotor to eccentrically distribute a weight of the rotor with respect to said rotational center.

2. The vane pump as in claim 1, wherein:

some weight of the rotor is removed to make the gravity center of the rotor eccentric with the rotational center.

3. The vane pump as in claim 2, wherein:

at least one depression that is open to one axial end of the rotor and extending in its axial direction is formed in the rotor to remove some weight of the rotor.

4. The vane pump as in claim 2, wherein:

at least one cutout groove extending in the axial direction of the rotor is formed on a circumferential surface of the rotor to remove some weight of the rotor.

5. The vane pump as in claim 2, wherein:

one end of the driving shaft coupled to the rotor has a half circular cross-section composed of an arc portion and a chord portion; and the driving shaft is coupled to the rotational center of the rotor so that the chord portion faces a position where the gravity center of the rotor is located.

6. The vane pump as in claim 1, wherein:

a weight is added to the rotor to make the gravity center eccentric with respect to the rotational center of the rotor.

7. The vane pump as in claim 6, wherein:

the weight is disposed in a depression formed in the rotor, the depression extending in the axial direction of the rotor.

* * * * *